US005456293A

United States Patent [19]

Ostermayer et al.

[11] Patent Number: 5,456,293

[45] Date of Patent: Oct. 10, 1995

[54] WOVEN PAPERMAKING FABRIC WITH DIAGONALLY ARRANGED POCKETS AND TROUGHS

[75] Inventors: Volker Ostermayer, Greenville; Scott Quigley, Simpsonville, both of S.C.

[73] Assignee: Wangner Systems Corporation, Greenville, S.C.

[21] Appl. No.: 283,533

[22] Filed: Aug. 1, 1994

[51] Int. Cl.[6] ..... D03D 15/00

[52] U.S. Cl. ..... 139/383 A

[58] Field of Search ..... 139/383 A; 428/257

[56] References Cited

U.S. PATENT DOCUMENTS

| | | | |
|---|---|---|---|
| 3,705,079 | 12/1972 | Lee et al. | 139/425 A X |
| 4,239,065 | 12/1980 | Trokhan | 139/383 A |
| 4,408,638 | 10/1983 | Strom | 139/383 A |
| 4,909,284 | 3/1990 | Kositzke | 139/383 A |
| 4,987,929 | 1/1991 | Wilson | 139/383 A |
| 5,228,482 | 7/1993 | Fleischer | 139/383 A |
| 5,297,590 | 3/1994 | Fleischer | 139/383 A |
| 5,366,798 | 11/1994 | Ostermayer | 139/383 A X |

*Primary Examiner*—Andy Falik

*Attorney, Agent, or Firm*—Cort Flint; Henry S. Jaudon

[57] ABSTRACT

A papermaking fabric woven to have a support surface which is defined by co-planar support surface crossovers of filaments in both the machine direction and cross machine direction and also to have sub-top surface crossovers of filaments which are distributed in a predetermined pattern throughout the support surface of the fabric. The specific weave pattern along with the use of different sized and specifically arranged yarns create staggered arrays of continuous trough like cavities and arrays of sequentially arranged individual cavities or pockets. The arrays of troughs and pockets extend diagonally of the fabric in alternating fashion across its width. The fabric is particularly useful for producing soft absorbent paper having low density, good strength, and reduced rigidity.

18 Claims, 2 Drawing Sheets

WOVEN PAPERMAKING FABRIC WITH DIAGONALLY ARRANGED POCKETS AND TROUGHS

This invention relates to papermaking fabrics for papermaking machines which include forming fabrics, backing fabrics and drying and imprinting fabrics. Particular emphasis is directed to drying and imprinting fabrics producing paper having arrays of uncompressed and compressed zones. Such paper after being creped is characterized by relatively high bulk and improved machine direction and cross machine direction fiber ratio, reduced flexural rigidity and improved strength.

BACKGROUND OF THE INVENTION

Numerous attempts have been made to provide a papermaking fabric capable of producing a paper product with increased bulk which provides for a softer and more absorbent product. Combined with increased bulk, the product must include improved flexibility while maintaining acceptable or improved strength. Early efforts to provide such a papermaking fabric are disclosed in U.S. Pat. No. 3,301,746 which discloses the use of square, diagonal, twill and semi-twill weaves. Another early effort is disclosed in U.S. Pat. No. 3,974,025 which discloses using the back surfaces of heretofore known papermaking fabrics. Another development in papermaking fabrics is disclosed in U.S. Pat. No. 4,239,065 to Trokham. This patent discloses a papermaker's fabric having a forming surface comprised of successive diagonal rows of coplanar crossovers forming individual pockets across and along the length of the fabric. U.S. Pat. No. 5,228,482 discloses a paper forming fabric similar to that of Trokham. Here the crossovers forming the successive rows of pockets are multi-planar.

These earlier patents disclose papermaking fabrics which produce paper having successive rows of pillows or uncompressed areas surrounded by lineaments of compressed areas. The rows of pillows and lineaments are arranged to extend transverse or diagonally of the paper.

Accordingly, an object of the instant invention is to provide a papermaking fabric capable of producing paper of high bulk and reduced rigidity.

Another object of the invention is to provide a papermaking fabric capable of producing paper of increased softness and absorbability.

A further object of the invention is to provide a paper imprinting fabric which produces paper having broken and discontinuous compressed lineaments over its surface.

A further object of the invention is to provide a papermaking fabric having a product support surface which produces uniform fiber orientation.

A further object of the invention is to provide a paper forming fabric having a paper product support surface having deep, well defined pockets and troughs extending transversely along and across the support surface.

A further object of the invention is to provide a papermaking fabric having improved stability.

SUMMARY OF THE INVENTION

The invention is direct to a loop of fabric for us on a papermaking machine. The fabric is comprised of a first set of filaments which are disposed generally parallel with respect to each other and a second set of filaments which are also generally disposed in parallel relation to each other. The sets of filaments are interwoven and configured to provide a predetermined first grouping of co-planar top-surface crossovers of both sets of filaments, and also a predetermined second grouping of recessed sub-top-surface crossovers of both sets of filaments. The top-surface crossovers are arranged in spaced relation to define arrays of cavities or pockets which are disposed in linear arrays. The second grouping of recessed sub-top-surface crossovers are arranged intermediate adjacent of the linear arrays of cavities to define troughs of sub-top-surface crossovers. The arrays of cavities and troughs extend diagonally along the length of the fabric.

A woven fabric for use on paper machines having a set of MD (machine direction) synthetic filaments disposed in generally parallel relationship and CMD (cross machine direction) synthetic filaments disposed generally in parallel relationship and transversely of said MD filaments. The MD and CMD filaments are interwoven with each other to be serpentinely configured to provide a first grouping of MD filaments having co-planar support surface crossovers which extend over CMD filaments and lie along a first substantially horizontal plane which extends over the support surface. A second grouping of MD filaments are provided which have sub-support surface crossovers which extend over CMD direction filaments to lie along a second substantially horizontal plane spaced below the first horizontal plane. The CMD filaments also form a second set of co-planar support surface crossovers which extend over MD filaments and lie along the second horizontal plane formed by the second grouping of MD crossovers.

The first grouping of MD crossovers and the first set of CMD crossovers are arranged in spaced relationship to define rows of diagonally arranged pockets across the support surface and along the length of the fabric. The second groupings of MD crossovers along with the second sets of CMD crossovers which extend along the sub support surface plane form surfaces of the pockets along with rows of troughs which extend across the support surface and along the length of the fabric. The rows of pockets and troughs are alternately arranged across the width of the fabric.

It is preferred that the filaments are synthetic monofilaments. Also, it is preferred that the monofilaments are formed of a polyester, a polyamide, a polyaryletherketones or a polyester, polyamide blend.

The CMD filaments forming the second sets of recessed sub-support-surface crossovers comprise filaments having a larger diameter than the CMD filaments forming the first sets of crossovers. Preferably the CMD filaments forming the first sets of crossovers are preferably between 0.26 and 0.34 mm in diameter while the CMD filaments forming the second sets of crossovers are preferably between 0.41 and 0.49 mm in diameter. The MD filaments forming both the first and second groupings of crossovers are preferably of one size which preferably range from between 0.30 and 0.38 mm in diameter. These sizes are not limiting and may be larger or smaller as dictated by the product desired. The ratio between sizes should be maintained.

The CMD filaments are arranged with the smaller filaments alternating successively with the larger filaments throughout the weave pattern.

The filaments forming the fabric may have a circular cross section, an oval cross section or a rectangular cross section. The fabric may be formed with filaments of all one cross section, of two cross sections or a plurality of cross sections. The shaped filaments may be woven in the MD, CMD or both.

The papermaking fabric of the invention is woven in a modified Atlas weave which comprises five MD filaments and ten CMD filaments for one pattern repeat.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
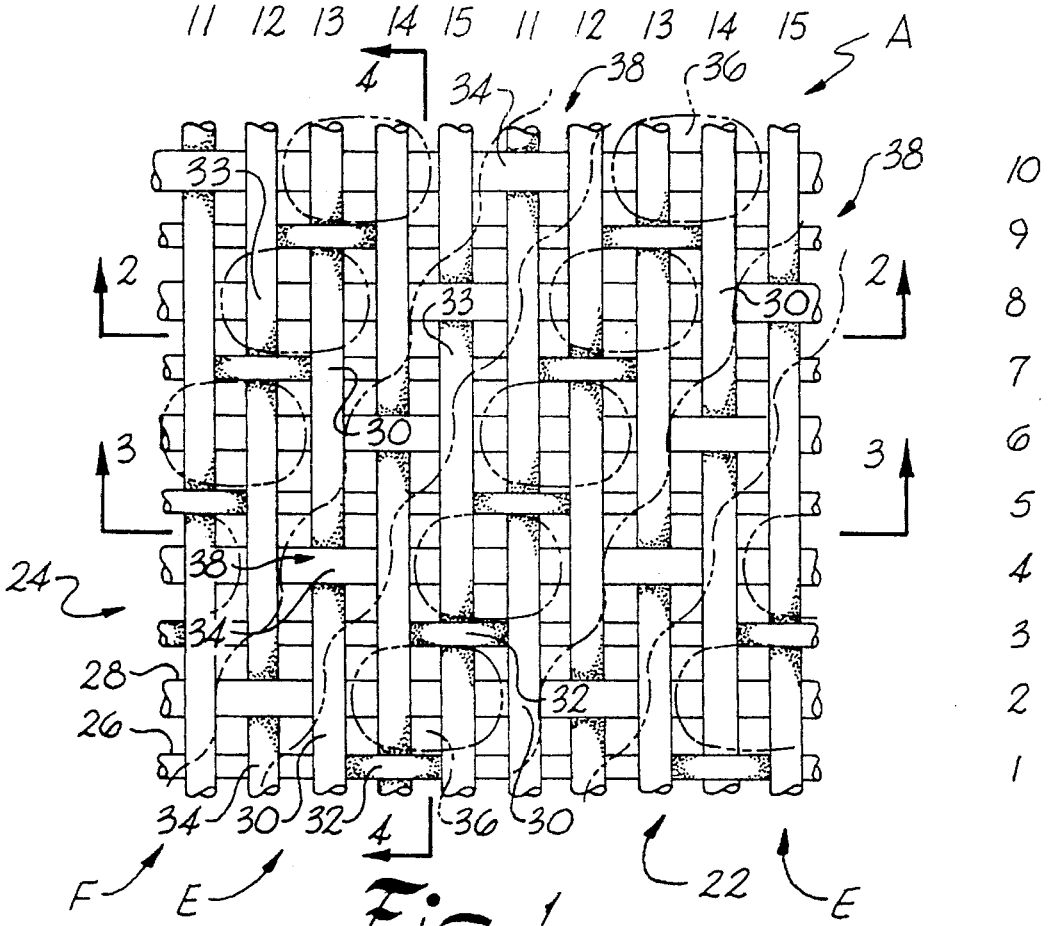
FIG. 1 is a top view of a repeat of the weave pattern of the fabric of the invention showing pockets and troughs, as formed by the large and small diameter CMD yarns interweaving with the MD filaments and arranged diagonally across the support surface.

FIG. 1 is a sectional top view which shows support surface A of a single repeat in the weft direction and two repeats in the warp direction of the weave pattern of the preferred embodiment of the invention. The weave pattern is a modified Atlas which consist of ten weft yarns which generally extend in the cross machine direction (CMD) and five warp yarns which generally extend in the machine direction (MD) per pattern repeat. The warp yarns of the pattern repeat are numbered 11–15 and are identified with numeral 22 while the weft yarns are numbered 1–10 and are identified with the numeral 24.

Weft yarns 24 comprise small diameter yarns 26 and large diameter yarns 28. These yarns are arranged throughout the weave pattern and along the length of the fabric in alternating manner as shown in FIG. 1. Large diameter weft yarns 28 normally have a diameter of between 0.41 and 0.49 mm with the preferred size being 0.45 mm. Small diameter weft yarns 26 normally have a diameter of between 0.26 and 0.34 mm with the preferred size being 0.30 mm. Weft yarns 24 preferably are formed of synthetic monofilaments having a circular cross section. It is within the realm of the invention that the weft yarns may also have shaped cross sections such as rectangular or oval and that all weft yarns may be of one or a plurality of cross sectional shapes. Alternatively shaped and circular cross sectional weft yarns could be utilized in an arranged sequence. The preferred synthetic materials forming the weft yarns are of polyamide, polyester, polyaryletherketones or a blend of any of the above.

Warp yarns 22 are preferable formed of synthetic monofilaments of a circular uniform diameter which normally ranges from between 0.30 and 0.38 mm. The preferred diameter is 0.34 mm. While it is preferred that the warp yarns are formed of monofilaments of circular cross section it is contemplated that shaped monofilaments as described above could be used. In another alternative arrangement, one or both of warp 22 and weft 24 could be formed of multifilament synthetic yarns. The warp yarns are preferably formed of the same synthetic materials as indicated for the weft yarns.

Again referring to FIG. 1, it can be seen that weft yarns 1 and 6 weave under warp yarns 11–13, over warp yarn 14 and under warp yarn 15. Weft yarns 2 and 7 weave under warp yarn 11, over warp yarn 12 and under warp yarns 13–15. Weft yarns 3 and 8 weave under warp yarns 11–14 and over warp yarn Weft yarns 4 and 9 weave under warp yarns 11 and 12, over warp yarn 13 and under warp yarns 14–15. Weft yarns 5 and 10 weave over warp yarn 11 and under warp yarns 12–15. While the warp, weft relationship between weft yarns 1, 6; 2, 7; 3, 8; 4, and 5, 10 is identical the resulting surface configuration differs through the ten pick repeat because the odd numbered weft yarns identified with numeral 26 are smaller in diameter than the even numbered weft yarns identified with number 28. As a result, it requires ten weft yarns and five warp yarns to produce a complete pattern repeat.

Figure 2:
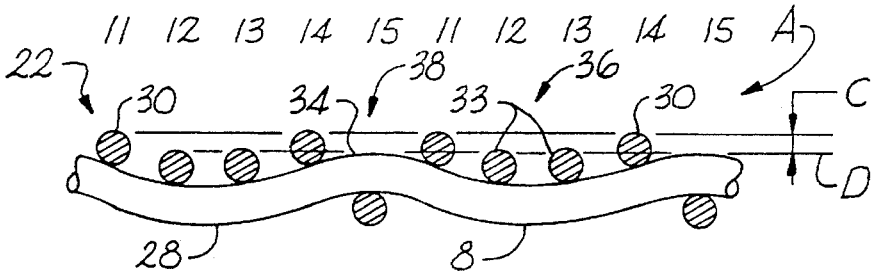
FIG. 2 is a section view taken along line 2—2 of FIG. 1 showing the MD, large diameter CMD yarn relationship.

Turning now to FIG. 2, taken along line 2—2 of FIG. 1, it can be seen that as weft yarn 8 of the large diameter weft yarns 28 traverses the smaller diameter warp yarns 22 there is a minimum amount of crimp produced in the weft yarn. This minimal crimp leaves the upper or crossover surfaces 34 of weft yarns 28 lying along lower or sub-support surface substantially horizontal plane D. Also, it can be seen that the upper surfaces of crossovers 33 of warp yarns 12 and 13 where they cross over weft 28, also are positioned to lie along the sub-support surface or lower substantially horizontal plane D. The upper surfaces or support surface crossover 30 of warp yarns 11 and 14 are elevated to extend along a common upper or support surface substantially horizontal plane D as they cross over the weft. The top surface crossovers 30 and 33 of the warp yarns create pockets 36 and troughs 38 which extend diagonally along the length of the fabric.

Figure 3:
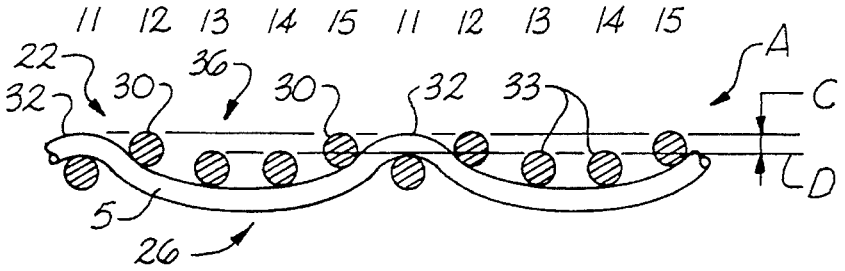
FIG. 3 is a sectional view taken along line 3—3 of FIG. 1 showing the MD, small diameter CMD yarn relationship.

Turning now to FIG. 3, a view similar to FIG. 2 but taken along line 3—3 of FIG. 1, the configuration of weft yarn 5, of smaller weft yarns 26, can be seen as it traverses through warp yarns 22. Again, the upper surfaces or crossover surfaces 30 of warp yarns 11 and 15 are brought into the common upper or support surface plane C as they cross over weft yarn while the upper surfaces or crossover surfaces 33 of warp yarns 13 and 14 where they cross over weft yarn 26 are aligned with sub-support surface plane D which lies below the plane C of the support surface crossovers. Weft yarns 26, which are of a diameter smaller than that of both weft yarn 28 and warp yarn are crimped by the larger diameter warp yarn as they cross thereover so that their upper surfaces 32 at the point of crossover with warp yarns 11 are raised or brought up to lie also along upper plane C to be aligned with the crossover surfaces 30 of warp yarns 12 and 15. Thus transverse lineaments are created by top surface crossovers 32 which result in the creation or the definition of pockets or cavities over the support surface of fabric. These pockets 36 extend along transverse lines E along the length of the fabric and in the machine direction.

Turning now to FIG. 1, it can be seen that support surface crossovers 30 of warp yarns 22 form picket like lineaments defining a series of troughs 38 over sub-support surface crossovers 34, of weft yarns 28 and sub-support surface crossovers 33 of warp yarns 22. These troughs are arranged along transverse lines F along the length of the fabric in the machine direction and in alternating relationship with lines E.

Figure 4:
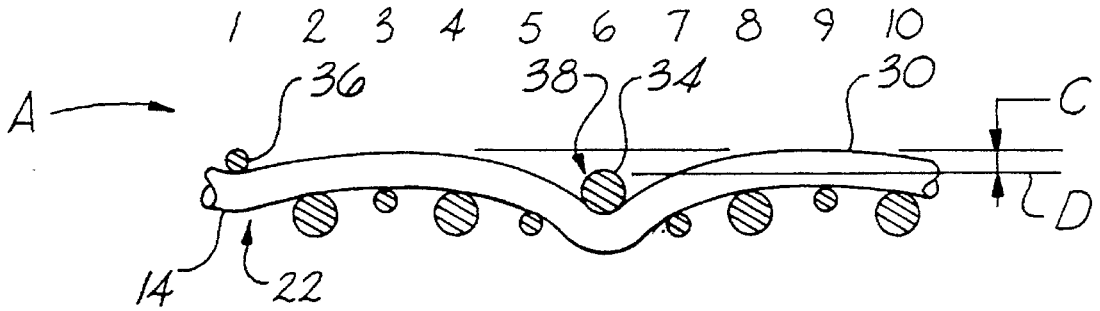
FIG. 4 is a sectional view taken along line 4—4 of FIG. 1 showing the large and small diameter CMD yarns relative to a MD yarn.
Figure 5:
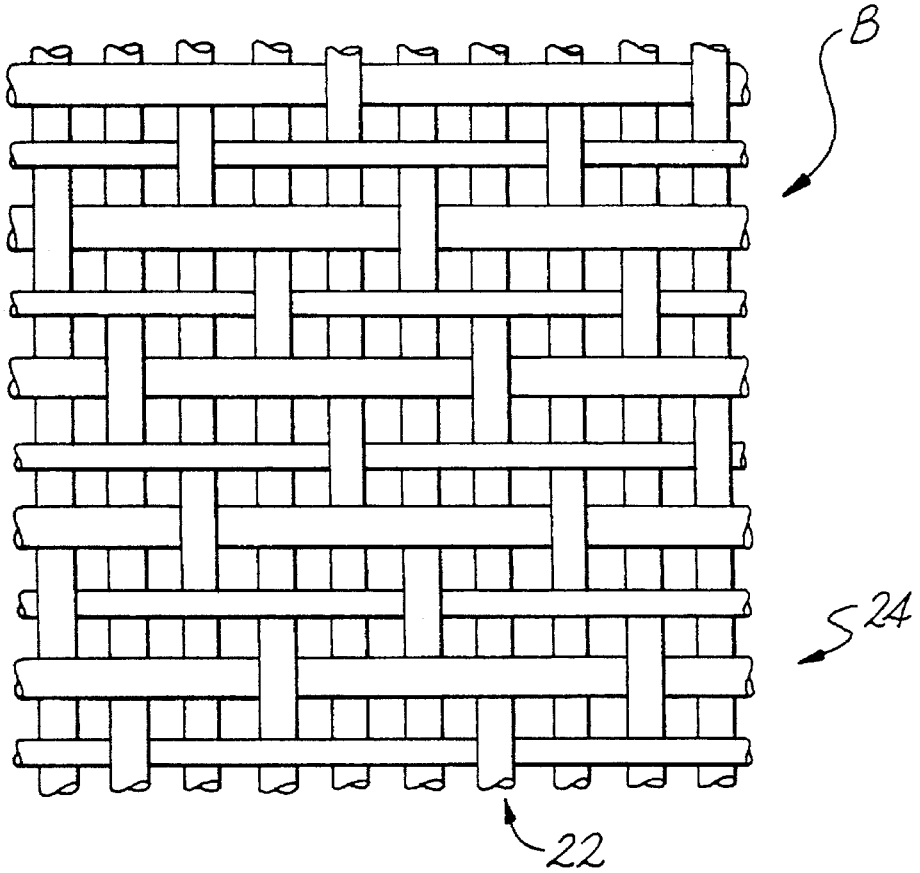
FIG. 5 is a bottom view of the fabric of the invention showing the weave configuration of the running surface.

FIG. 4 shows the positions of warp yarn 14 of the warp yarns 22 as it passes through the weave pattern. It can be seen that as warp yarn 14 passes under weft yarn 1 and over weft yarn 2, a sub-support crossover is created which forms a section of a pocket 36. Also, a section of trough 38 is created where warp yarn 14 passes beneath large weft yarn 6 whose upper surface remains tangent with plane D. It is again noted that support surface crossovers 30 lie along plane C while the sub-support surface crossovers lie along plane D.

It is necessary that pockets 36 and troughs 38 be well defined and of sufficient depth over support surface A of the fabric in order to insure that the dryer fabric impart a distinctive and well defined imprint on the paper produced. This is accomplished by bringing support surface crossovers 30 and 34 into position so that they lie substantially along the common plane C. Also, the sub-support surface crossovers 32 and 33 are also arranged to lie substantially along the common plane D. The distance between planes C and D is at least between 0.05 and 0.09 mm with 0.07 mm being the preferred separation distance. In certain instances, it may be necessary to grind the support surface in order to more uniformly bring the support surface crossovers into alignment. This in no way alters the weave structure or concept of the invention.

In operation, the paper forming fibers are deposited and pressed on the support A of the dryer fabrics. Continuous troughs 38 create spaced continuous pillows of uncompacted paper fibers diagonally along the length of the paper formed on fabric. The continuous rows of pockets 36 create continuous diagonal rows of individual pillows of uncompacted paper fibers intermediate the rows of continuous pillows along the length of the paper. Both the individual and continuous pillows give the paper greater softness and absorbability. The lineaments or pickets created by top surface crossovers 30, 32 form zones or lines of compressed paper fibers outlining each of the individual pillows and, the continuous rows of pillows giving strength and stability to the paper. The absence of lineaments transverse of the length of the continuous pillows reduces rigidity in the paper.

FIG. 4 shows the running surface B of the paper making fabric of the invention. This surface does not provide a uniform support surface or a surface having depressions of uniform depth due to the manner in which large weft yarns 26 and small weft yarns 28 intermesh with warp yarns 22.

While a preferred embodiment of the invention has been described using specific terms, such description is for illustrative purposes only, and it is to be understood that changes and variations may be made without departing from the spirit or scope of the following claims.

What is claimed is:

1. A loop of fabric for use on a papermaking machine, said fabric comprising a first set of filaments which filaments are disposed generally parallel with respect to each other and a second set of filaments which filaments are generally disposed in parallel relation to each other and which filaments are angularly disposed with respect to the filaments of said first set of filaments, said sets of filaments being interwoven and serpentinely configured to provide a predetermined first grouping of co-planar top-surface crossovers of both said sets of filaments, and a predetermined second grouping of recessed sub-top-surface crossovers of both of said sets of filaments, said top-surface crossovers of both said sets of filaments being in spaced relation to define a plurality of discrete individual cavities disposed in linear arrays, said top-surface crossovers of one of said sets of filaments being arranged to define uninterrupted troughs intermediate adjacent of said linear arrays of discrete cavities, said discrete cavities and uninterrupted troughs extending along the length of the fabric.

2. The loop of fabric of claim 1 wherein said arrays of discrete cavities and said uninterrupted troughs are arranged to extend diagonally across said fabric.

3. A woven fabric for use on paper machines having a support surface and a running surface, said fabric comprising MD synthetic filaments disposed in generally parallel relationship; CMD synthetic filaments disposed generally in parallel relationship and transversely of said MD filaments;

said MD and CMD filaments being interwoven with each other so as to be serpentinely configured to provide a first grouping of MD filaments having co-planar support surface crossovers which extend over filaments of said CMD filaments and lie substantially along a first plane, and a second grouping of MD filaments having sub-support surface crossovers which extend over filaments of the CMD filaments and lie substantially along a second plane, said second plane being generally parallel with and spaced below said first plane;

said CMD filaments having a first set of co-planar support surface crossovers which extend over MD filaments and lie along said first plane formed by said first grouping of MD crossovers and a second set of co-planar support surface crossovers which extend over MD filaments and lie along said second plane formed by said second grouping of MD crossovers;

said first grouping of MD crossovers and said first set of CMD crossovers are arranged in spaced relationship so as to define rows of successive diagonally arranged pockets across said support surface and along the length of said fabric;

said first grouping of MD crossovers, further defining rows of troughs which extend across said support surface and along the length of said fabric, said rows of troughs being arranged intermediate said rows of pockets.

4. The fabric of claim 3 wherein said filaments are synthetic monofilaments.

5. The fabric of claim 4 wherein said monofilaments are comprised of material selected from the group consisting of polyester, polyamide, polyaryletherketones and polyester, polyamide blends.

6. The fabric of claim 3 wherein said CMD filaments forming said second sets of recessed sub-top-surface crossovers comprises filaments having a larger diameter than said CMD filaments forming said first sets of crossovers.

7. The fabric of claim 6 wherein said MD filaments are any of a lesser diameter than said CMD filaments forming said second sets of crossovers and of a greater diameter than said CMD filaments forming said first sets of crossovers.

8. The fabric of claim 6 wherein said CMD filaments forming said first sets of crossovers have a diameter of between 0.26 and 0.34 mm and said CMD filaments forming said second set of crossovers have a diameter of between 0.41 and 0.49 mm.

9. The fabric of claim 6 wherein said CMD filaments forming said first sets of crossovers are 0.30 mm in diameter and said CMD filaments forming said second sets of crossovers are 0.45 mm in diameter.

10. The fabric of claim 6, wherein said larger diameter CMD filaments are arranged in alternating manner with said smaller diameter CMD filaments throughout the weave pattern.

11. The fabric of claim 3 wherein said MD directions are uniform in diameter.

12. The fabric of claim 3 wherein at least one of said CMD and said MD direction filaments have a circular cross section.

13. The fabric of claim 3 wherein at least one set of said CMD and MD direction filaments have a shaped cross section.

14. The fabric of claim 3 wherein said MD direction filaments have a diameter of between 0.30 and 0.38 mm.

15. The fabric of claim 3 wherein said weave comprises a ten MD filament and a five CMD filament repeating pattern.

16. The fabric of claim 3 wherein said troughs have a depth which extends more than 0.05 mm below said first plane.

17. The fabric of claim 3 wherein said pockets have a depth which extends more than 0.05 mm below said first plane.

18. The fabric of claim 3 wherein said second plane is spaced below said first plane by between 0.05 mm and 0.09 mm.

* * * * *